US005862852A

United States Patent [19]

Shibata et al.

[11] Patent Number: 5,862,852

[45] Date of Patent: Jan. 26, 1999

[54] PRODUCTION METHOD FOR A CYLINDER BLOCK OF AN INTERNAL COMBUSTION ENGINE

[75] Inventors: Yukihiro Shibata; Shigeki Okaguchi; Mitsuhiro Karaki, all of Okazaki, Japan

[73] Assignee: Toyota Jidosha Kabushiki Kaisha, Toyota, Japan

[21] Appl. No.: 760,144

[22] Filed: Dec. 3, 1996

[30] Foreign Application Priority Data

Dec. 4, 1995 [JP] Japan ..... 7-315190
Nov. 21, 1996 [JP] Japan ..... 8-309833

[51] Int. Cl.[6] ..... B22D 19/00; B22D 19/08; B22D 19/16; B22D 23/06

[52] U.S. Cl. ..... 164/80; 164/94; 164/95; 164/113; 164/137

[58] Field of Search ..... 164/94, 95, 80, 164/113, 137

[56] References Cited

U.S. PATENT DOCUMENTS 1,336,212 4/1920 Evon .
2,890,490 6/1959 Morin .
2,948,031 8/1960 Webb .
3,083,424 4/1963 Bauer .
4,362,686 12/1982 Clishem et al. .
4,446,906 5/1984 Ackerman et al. .

FOREIGN PATENT DOCUMENTS 59-150715 8/1984 Japan .
1-031981 6/1989 Japan .
2-037955 2/1990 Japan .
3-133558 6/1991 Japan .
4-076252 3/1992 Japan .
WO 92/15415 9/1992 WIPO ..... 165/98

OTHER PUBLICATIONS

Abstract of Japanese Patent Publication 9–108818 published Apr. 28, 1997.

*Primary Examiner*—J. Reed Batten, Jr.
*Attorney, Agent, or Firm*—Pillsbury Madison & Sutro LLP

[57] ABSTRACT

A first cavity is formed between a mold and a core. One of a cylinder block material and a liner material is supplied to the first cavity. A second cavity is formed by expanding or shrinking the core or replacing the core with another core. The other of the cylinder block material and the liner material is supplied to the second cavity. The cylinder block with a liner is produced successively using the same apparatus.

21 Claims, 4 Drawing Sheets

1
1a
1b
1c
2
2a
2b
2'
2a'
2b'
3
4
5
6
7
8
9
10
10'
11
12
12'
13
14
15
16
17

1
1a
1b
1c
2
2a
2b
2'
2a'
2b'
3
4
5
6
7
10
10'
11
12A
12A'
16
18

1
1a
1d
10
2
2b
2a
5
11
4
20
19
1b
12B
1e
1c
3
21
16
12B'

PRODUCTION METHOD FOR A CYLINDER BLOCK OF AN INTERNAL COMBUSTION ENGINE

The priority applications, Japanese Patent Application No. HEI 7-315190 filed in Japan on Dec. 4, 1995 and Japanese Patent Application HEI 8-309833 filed in Japan on Nov. 21, 1996, are hereby incorporated by reference into the subject application.

BACKGROUND OF THE INVENTION

1. Field of the Invention

The present invention relates to a production method for a cylinder block with a liner, of an internal combustion engine.

2. Description of Related Art

For a production method for a cylinder block with a liner, there are two methods: ① to press-in a machined liner to a hole formed in a cylinder block and ② to set a liner manufactured at a different step in a mold and then to supply a molten cylinder block material into the mold thereby molding the cylinder block integrally with the liner.

Japanese Patent Publication No. HEI 2-37955 discloses the above-described production method +e,fra 2+ee , wherein a pre-manufactured liner is inserted into a mold, then a molten cylinder block material is supplied into the mold thereby integrally casting the cylinder block with a liner, and then the liner is machined.

However, the conventional methods have the following problems:

With the above-described method ①, a liner manufacturing step needs to be provided independently of the cylinder block casting step, which increases the number of steps necessary in producing the cylinder block with a liner.

With the above-described method ②, since the liner is manufactured at a step independent of the cylinder block casting step, the same problem as with the method ① arises. In addition, with the method ② there is a problem that since a clearance needs to be provided between the liner and the mold when the liner is set in the mold, when the liner is set within the mold, the liner may be dislocated from a correct position due to a dimensional error of a liner supporting member.

SUMMARY OF THE INVENTION

An object of the present invention is to provide a method for producing a cylinder block with a liner for an internal combustion engine where the number of steps necessary in producing the cylinder block with a liner is reduced and dislocation of the liner relative to the cylinder block is prevented or suppressed.

A method for producing a cylinder block with a liner for an internal combustion engine according to the present invention includes a first cavity forming step, a first material-supplying step, a second cavity forming step, and a second material-supplying step. In the first cavity forming step, a first cavity for receiving one of a cylinder block material and a liner material therein is formed between a mold and a core. In the first material-supplying step, one of a cylinder block material and a liner material is supplied into the first cavity. In the second cavity forming step, a distance between the mold and the core is increased thereby forming a second cavity, on one side of the supplied one of the cylinder block material and the liner material, for receiving the other of the cylinder block material and the liner material. In the second material-supplying step, the other of the cylinder block material and the liner material is supplied into the second cavity.

In the above-described method according to the present invention, since the cylinder block and the liner is successively produced using the same apparatus, the liner does not need to be manufactured at a step independent of the cylinder block casting step, so that a number of production steps is reduced. Further, because of the successive production of the cylinder block and the liner using the same apparatus, the liner will be not dislocated within the mold, unlike the conventional method where a liner is pre-manufactured at a different step and then is set within a mold with a clearance. Since there is little or no dislocation of the liner relative to the cylinder block, an extra wall thickness for absorbing a dimensional error due to the dislocation does not need to be provided in the cylinder block and the liner. As a result, the wall thickness of the cylinder block and the liner can be thinner, which will lighten and slim the engine.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 4:
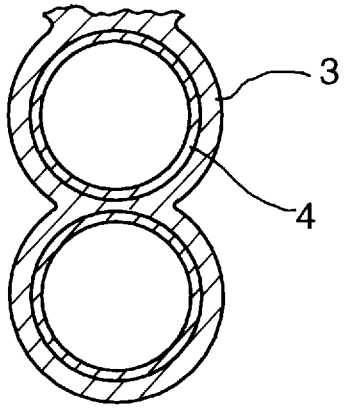
FIG. 4 is a cross-sectional view of a cylinder block taken in plane perpendicular to a cylinder bore axis showing one type of a liner portion.
Figure 5:
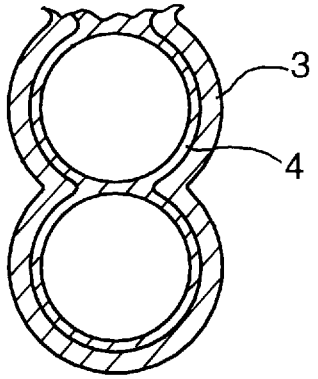
FIG. 5 is a cross-sectional view of a cylinder block taken in plane perpendicular to a cylinder bore axis showing another type of a liner portion.
Figure 6:
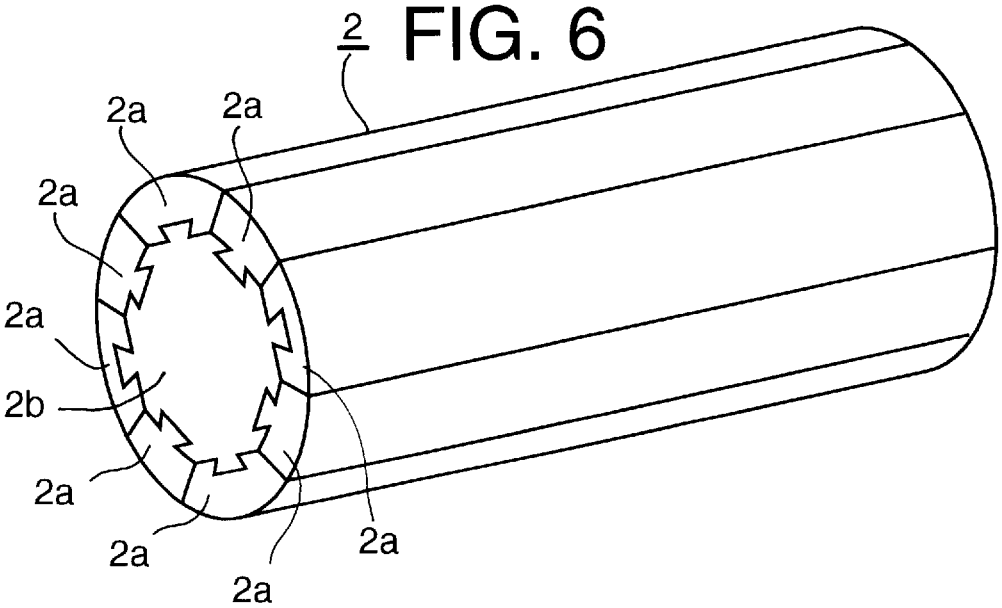
FIG. 6 is an oblique view of the core.

FIGS. 1A–1D illustrate a method according to a first embodiment of the present invention; FIGS. 2A–2D illustrate a method according to a second embodiment of the present invention; and FIGS. 3A–3D illustrate a method according to a third embodiment of the present invention. FIGS. 4–6 are applicable to any embodiment of the present invention. Portions common to all of the embodiments of the present invention are denoted with the same reference numerals throughout all of the embodiments of the present invention.

First, portions common to all of the embodiments of the present invention will be explained with reference to, for example, FIGS. 1A–1D, and 4–6.

A method for producing a cylinder block with a liner according to any embodiment of the present invention includes a first cavity forming step, a first material-supplying step, a second cavity forming step, and a second material-supplying step.

In the first cavity forming step, a first cavity 5 for receiving one of a cylinder block material 3 and a liner material 4 therein is formed between a mold 1 (which may include a liner portion forming wall) and a core 2. The mold 1 includes, for example, an upper segment 1*a,* a lower segment 1*b,* and a plurality of side segments 1*c.* As illustrated in FIG. 6, the core 2 includes, for example, a plurality of petal members 2*a* arranged on a circle and a core member 2*b* axially tapered and axially movable relative to the petal members 2*a* and in contact with the petal members 2*a.* When the core member 2*b* is slid axially relative to the petal members 2*a,* the core member 2*b* causes the petal member 2*a* to move in a radial direction of the core 2. In a case where the first cavity is a liner formation cavity, the first cavities 5 of all of the cylinders of the engine may be independent of each other as illustrated in FIG. 4 or may be integral with each other as illustrated in FIG. 5. The core 2 is held by a holding member 10.

In the first material-supplying step, one of the cylinder block material. 3 and the liner material 4 is supplied to the first cavity 5.

In the second cavity forming step, a distance between the mold 1 and the core 2 is increased thereby forming a second cavity 6, on one side of the one of cylinder block material 3 and a liner material 4 supplied to the first cavity 5, for receiving the other of the cylinder block material 3 and the liner material 4. The increase of the distance between the mold 1 and the core 2 is performed by replacing one of the mold 1 and the core with another mold 1' or core 2' or by expanding or contracting the petal members 2*a* arranged on a circle. The core 2' is supported by a support member 10'.

In the second material-supplying step, the other of the cylinder block material 3 and the liner material 4 (i.e., the material which has not been supplied into the first cavity) is supplied into the second cavity 6.

In the above method, a cylinder block portion and a liner portion are successively formed using the same cylinder block producing apparatus. As a result, manufacturing a liner using a different apparatus, cutting of the liner, machining of the liner, and setting the liner within a mold, which need to be conducted in the conventional cylinder block producing method, are eliminated from the cylinder block producing method according to the present invention, resulting in decreasing the number of steps necessary in production of a cylinder block. In addition, since the liner portion and the cylinder block portion are cast or produced using the same producing apparatus, a dimensional error which tends to be caused in the conventional method during setting a core manufactured at a different station within a mold will not be caused. Further, there is no need to increase the thicknesses of the liner and the cylinder block by the dimensional error for absorbing the error. As a result, the cylinder block with a liner is lightened and is compact.

Next, portions unique to each embodiment of the present invention will be explained.

The first embodiment of the present invention is a case where the liner material is aluminum and is supplied in the form of a molten aluminum, and the cylinder block material is aluminum. Firstly the cylinder block portion is cast and then the liner portion is cast.

Figures 1A, 1B, 1C, 1D:
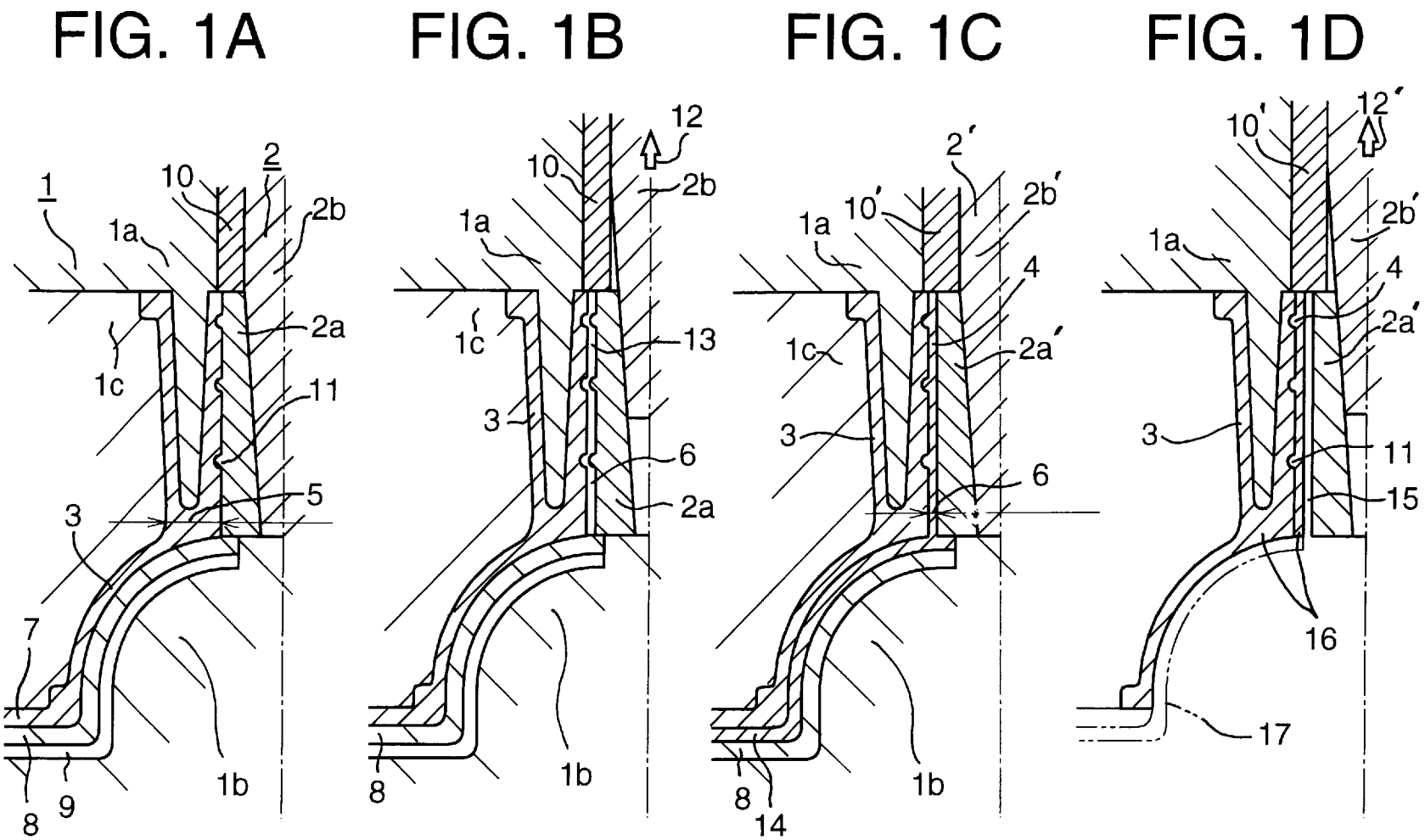
FIGS. 1A–1D are cross-sectional views of a mold and a core at particular steps of a method for producing a cylinder block of an internal combustion engine according to a first embodiment of the present invention.

FIG. 1A illustrates a stage where the first cavity 5 has been formed, and to the first cavity 5, the cylinder block material 3 which is aluminum has been supplied to solidify. In the first cavity forming step, a first gate 7 is formed in the mold, for example, in the side segment 1*c*. Further, a second gate core 8 is set to the mold 1, for example, in the lower segment 1*b,* and a space 9 for allowing the second gate core 8 to move thereto is formed in the mold. The member 10 supports the core 2. Each petal member 2*a* of the core 2 has an outside surface including protrusions 11 for increasing an anchoring effect (anchoring strength) of the liner portion with the cylinder block portion. In the first material-supplying step, the block material 3 of aluminum is supplied in a molten state into the first cavity 5 and then solidifies, whereby the block portion is cast.

FIG. 1B illustrates a core removing step for forming the second cavity 6. When the cylinder block material contacting the surfaces of the petal members 2*a* of the core has solidified, the core member 2*b* is moved in a direction denoted with arrow 12 so that the diameter of the circle on which the petal members 2 are arranged is reduced to form a clearance 13. Then, the core 2 including the petal members 2*a* and the core member 2*b* is moved upwardly utilizing the clearance 13 and is removed.

Then, as illustrated in FIG. 1C, another core 2' which is smaller than the original core 2 and includes a plurality of petal members 2*a'* and a core member 2*b'* is inserted into the mold 1, so that a second cavity 6 for forming a liner portion is formed within and on a side of the cast cylinder block portion. The core 2' is supported by the support member 10'. Further, the second gate core 8 is moved downwardly utilizing the space 9 thereby forming a second gate 14.

FIG. 1C illustrates a state after the second material-supplying step. A liner material 4 (for example, hypereutectic crystalline aluminum A390 having a high rate of Si in a molten state is supplied into the second cavity 6 through the second gate 14. The liner material 4 solidifies to provide a liner portion. The liner portion is integral with the cylinder block portion, and is anchored with the cylinder block portion by protrusions 11.

FIG. 1D illustrates a product removing step. After the liner material 4 has solidified the lower segment 1*b* and the side segments 1*c* are moved and the petal members 2' are contracted or reduced in size due to the tapered structure, so that a clearance 15 for removing the cast product is formed. The core 2' and the support member 10' are moved upwardly (in a direction denoted with arrow 12') utilizing the clearance 15, and are removed from the product. Thereafter, the cast product 16 is removed from the upper segment 1*a*. The bead portions of the product 16 corresponding to the first and second gates are machined to be removed.

In the first embodiment of the present invention, since a synthetic core 2, 2' each including the petal members 2*a, 2a'* and the core member 2*b, 2b'* is used for the respective core 2, 2', expansion and shrinkage of the core 2, 2' and replacement of the core 2 with another core 2' are easy, so that formation of the first cavity 5 and the second cavity 6 is easy.

The second embodiment of the present invention is a case where the liner material is aluminum and is supplied in the form of powder, and the cylinder block material is aluminum. As illustrated in FIGS. 2A–2D, firstly the cylinder block portion is cast, and then the liner portion is formed.

Figures 2A, 2B, 2C, 2D:
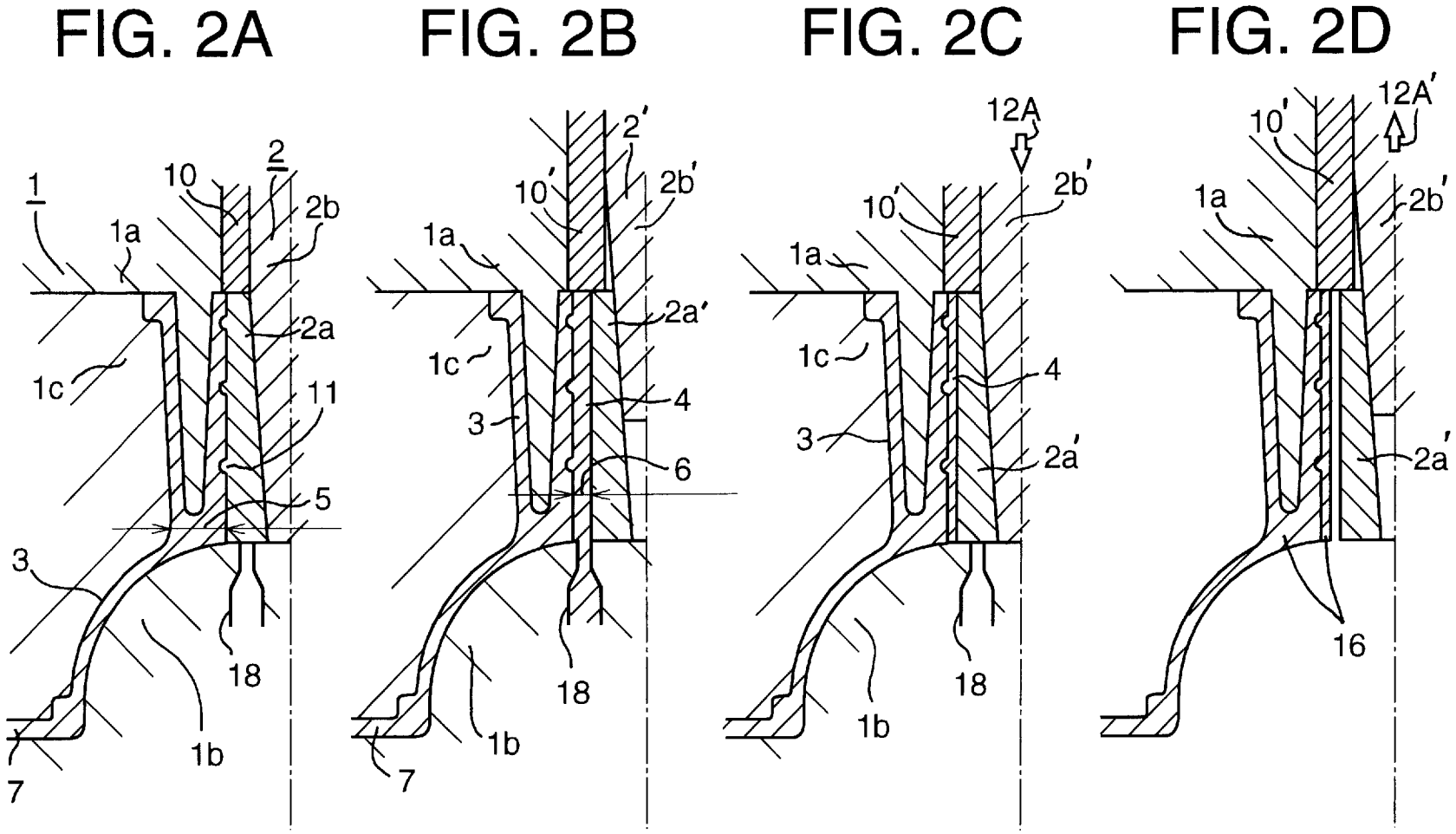
FIGS. 2A–2D are cross-sectional views of a mold and a core at particular steps of a method for producing a cylinder block of an internal combustion engine according to a second embodiment of the present invention.

FIG. 2A illustrates a stage after the first cavity forming step and the first material-supplying step, where the first cavity has been formed, and to the first cavity, the cylinder block material 3 which is aluminum has been supplied to solidify. In the lower segment 1*b* of the mold 1, a second gate 18 for supplying powders from a powder source into the second cavity therethrough is formed.

FIG. 2B illustrates a stage after the second cavity forming step and the second material-supplying step. In the second cavity forming step, the core 2 is replaced with another core 2' which is smaller than the original core 2. The second cavity 6 is formed inside and on a side of the cylinder block portion. In the second material-supplying step, the liner material 4 which is in a state of powder is supplied, by injection or suction, through the second, powder material supplying gate 18 into the second cavity 6 to fill the second cavity 6.

FIG. 2C illustrates a state where after the powder liner material 4 has filled the second cavity, the core member 2*b'* of the replacing core 2' has been moved in an axial direction denoted with arrow 12A to expand the petal members 2*a'*. Due to the expansion of the core 2', the powder liner material 4 is pressed to increase its density. At the same time as the expansion of the core 2', the gate 18 is shut by the core 2', and the powder remaining in the gate 18 is retrieved by the suction device (not shown).

Then, the powder liner material 4 in the second cavity 6 is heated to become solid by heating the core 2' using, for example, electromagnetic induction device. Heating the powder material 4 which has been supplied into the second cavity 4 may be conducted after pressing the powder material to increase its density or without via the pressing and density increasing step.

FIG. 2D illustrates a step for removing the product from the mold and the core. In the step, after the lower segment 1*b* and the side segments 1*c* have been removed, the core member 2*b'* is moved in a direction denoted with arrow 12A' to thereby shrink or contract the core 2'. Then, the product 16 is removed from the upper segment 1*a* and the core 2'.

In the second embodiment of the present invention, since a powder material is used for the liner material 4, a portion for casting the liner portion does not need to be provided, so that the casting apparatus is simplified. In a case where the powder material is pressed, the density of the material is increased so that a high quality of liner portion is produced.

In the above-described first and second embodiments, though the larger sized petal members 2*a* are replaced with the smaller sized petal members 2*a'*, the replacement does not necessarily need to be conducted, if the protrusions of the outside surfaces of the petal members 2*a* are allowed to be transferred to an inside surface of the liner portion (for example, in a case where the inside surface of the liner portion is machined and the machining amount is increased).

The third embodiment of the present invention is a case where the liner material 4 is cast iron and is supplied in the form of molten metal, and the cylinder block material is aluminum. Firstly, the cylinder block portion is cast, and then the liner portion is formed, because cast iron has a higher melting point than aluminum.

Figures 3A, 3B, 3C, 3D:
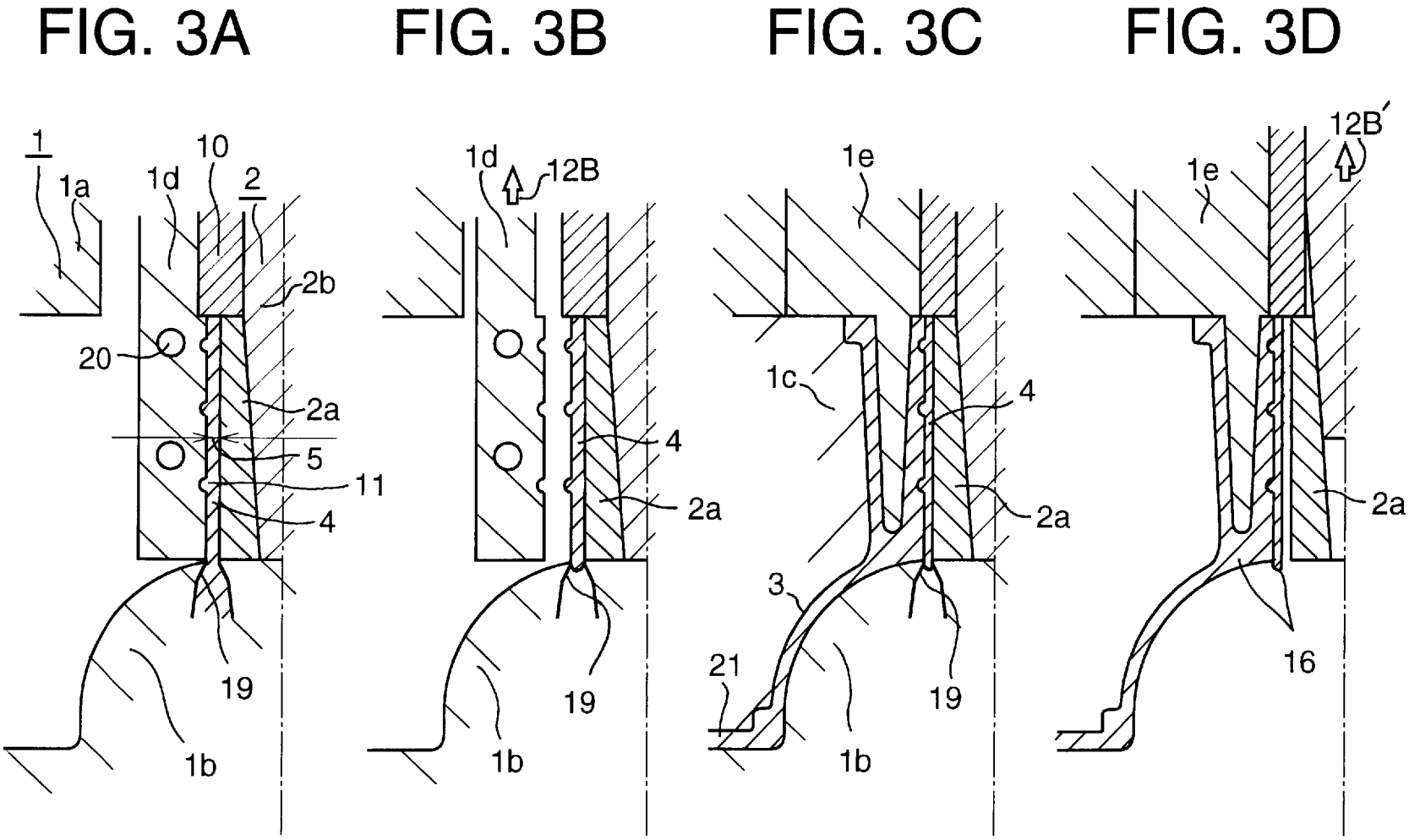
FIGS. 3A–3D are cross-sectional views of a mold and a core at particular steps of a method for producing a cylinder block of an internal combustion engine according to a third embodiment of the present invention.

FIG. 3A illustrates a state after the first cavity forming step and the first material-supplying step. The mold 1 has a liner portion forming wall 1*d*. In the first cavity forming step, the first cavity 5 is formed between the liner portion forming wall 1*d* and the core 2. In the first material-supplying step, the liner material 4 of molten cast iron is supplied into the first cavity 5 to fill it through a first gate 19 by injection or suction. The liner portion forming wall 1*d* is integrally formed in the upper segment 1*a*. The liner portion forming wall 1*d* defines an outside surface of an integral liner formed from multi-liners as shown in FIG. 5. The core 2 is set within the mold 1 with the petal members 2*a* are expanded, and the liner portion forming wall 1*d* is set at a position spaced away by a thickness of a liner portion (a thickness of the first cavity 5) from the outside surfaces of the expanded petal members 2. When the liner material 4 of molten cast iron is supplied into the first cavity 4 to fill the first cavity 4, a coolant (for example, cooling water) is caused to flow through a cooling passage 20 formed in the liner portion forming wall 1*d*, whereby solidification of the molten metal is promoted. Preferably, the liner portion forming wall 1*d* is made from copper-based material which has a high thermal conductivity.

At a step illustrated in FIG. 3B, the liner portion forming wall 1*d* is moved laterally and then upwardly (in a direction denoted with arrow 12B) to be removed. Lateral movement of the liner portion forming wall 1*d* may be conducted by a mechanism similar to that of the petal members of the core or a cylinder. Before the removal of the liner portion forming wall 1*d*, at a time when the cast iron in the liner portion has solidified but the cast iron in the gate 19 has not yet solidified, the injection or suction of the molten cast iron is stopped and the cast iron in the gate 19 is returned to the cast iron source.

At step illustrated in FIG. 3C, a water jacket forming core 1*e* and a plurality of side cores 1*c* are set in the mold 1, and then the block material 3 of aluminum is injected in a molten state into the second cavity to form the cylinder block portion. FIG. 3D illustrates a state where the lower segment 1*b* and the side segments 1*c* have been removed and the core 2 has been contracted and is moved in an upward direction denoted with arrow 12B'. Then, a product 16 (a cylinder block with a liner) is removed from the upper segment.

In the third embodiment of the present invention, since firstly the molten cast iron has completed solidification and then the molten aluminum 3 is supplied, the liner portion does not melt during casting the cylinder block portion.

FIGS. 4 and 5 illustrates two types of liner portions. More particularly, in the liner portion of the type of FIG. 4, liner formation cavities of all cylinders of the engine are independent of each other. Therefore, there is a cylinder block material 3 between adjacent liner portions. Preferably, this type of liner portion is applied to the first and second embodiments of the present invention. In the liner portion of the type of FIG. 5, liner formation cavities of all cylinders of the engine are integral with each other. Preferably, this type of liner portion is applied to the third embodiment of the present invention.

According to the present invention, the following advantages are obtained:

First, since the liner portion and the cylinder block portion are formed successively using the same apparatus, a number of steps needed in production can be reduced. Further, accuracy in dimension during producing a cylinder block with a liner is improved, so that thinning thicknesses of the liner portion and the cylinder block portion, lightening the engine, and making the engine compact are possible.

Second, by using the core including the petal members and the core member, formation of the cavities is easy and the producing steps are simplified.

Third, by using a powder material for the liner material and heating the powder material to solidify it, casting the liner portion does not need to be conducted, so that a casting apparatus therefor is simplified.

Fourth, by pressing the powder material by petal members of the core before heating the powder material, the density of the powder material is increased and the quality of the liner portion is improved.

Lastly, in a case where the liner material is cast iron and the cylinder block material is aluminum, by firstly casting the liner portion and then casting the cylinder block portion, melting of the liner portion during casting the cylinder block portion can be prevented.

Although the present invention has been described with reference to specific exemplary embodiments, it will be appreciated by those skilled in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. A production method for a cylinder block of an internal combustion engine comprising the steps of:

forming a first cavity between a mold and a core, for receiving one of a cylinder block material and a liner material therein;

supplying said one of a cylinder block material and a liner material into said first cavity;

increasing a distance between said mold and said core thereby forming a second cavity on one side of the supplied said one of a cylinder block material and a liner material, for receiving the other of the cylinder block material and the liner material; and supplying said other of the cylinder block material and the liner material into said second cavity.

2. A method according to claim 1, wherein said core includes a plurality of petal members arranged on a circle and a core member axially movable relative to said petal members, said second cavity forming step including reducing a diameter defined by said petal members by moving said core member.

3. A method according to claim 1, wherein during said second cavity forming step, said core is replaced by another core different in size from said core.

4. A method according to claim 1, wherein both said supplying steps comprise casting the cylinder block material and forming the liner material successively to form a product and removing the product from the mold and core.

5. A method according to claim 1, wherein one of said first cavity and said second cavity is a liner formation cavity, and liner formation cavities of all cylinders of said internal combustion engine are independent of each other.

6. A method according to claim 1, wherein one of said first cavity and said second cavity is a liner formation cavity, and liner formation cavities of all cylinders of said internal combustion engine are integral with each other.

7. A method according to claim 1, wherein said liner material is aluminum and is supplied in the form of a molten aluminum, and said cylinder block material is aluminum.

8. A method according to claim 7, wherein firstly a cylinder block portion is cast in said first cavity and thereafter a liner portion is formed in said second cavity.

9. A method according to claim 7, further including providing said core with an outside surface having protrusions for increasing an anchoring strength of a liner portion with a cylinder block portion.

10. A method according to claim 7, further including forming a first gate in said mold, and setting a second gate core in said mold where a space for allowing said second gate core to move thereto is formed, and wherein said one of a cylinder block material and a liner material is supplied in a molten state into said first cavity through said first gate, then said second gate core is moved into said space to thereby form a second gate, and then said other of the cylinder block material and the liner material is supplied in a molten state into said second cavity through said second gate.

11. A method according to claim 10, further including removing portions of said cylinder block material and said liner material which have solidified in said first gate and said second gate after a cast product is taken out from said mold and said core.

12. A method according to claim 1, wherein said liner material is aluminum and is supplied in the form of powder, and said cylinder block material is aluminum.

13. A method according to claim 12, wherein firstly a cylinder block portion is cast in said first cavity, and thereafter a liner portion is formed in said second cavity.

14. A method according to claim 12, further including providing said core with an outside surface having protrusions for anchoring a liner portion to a cylinder block portion.

15. A method according to claim 12, further including forming a first gate and a second gate in said mold, and wherein said one of the cylinder block material and the liner material is supplied in a molten state into said first cavity through said first gate and said other of the cylinder block material and the liner material is supplied in the form of powder into said second cavity through said second gate.

16. A method according to claim 12, wherein after said liner material has been supplied into said second cavity to fill said second cavity, said liner material in the form of powder is pressed to increase in density, and then said liner material is heated to solidify the liner material.

17. A method according to claim 12, wherein after said liner material has been supplied into said second cavity to fill said second cavity, said liner material in the form of powder is heated to solidify the liner material without being pressed.

18. A method according to claim 1, wherein said liner material is cast iron and is supplied in a molten state, and said cylinder block material is aluminum.

19. A method according to claim 18, wherein firstly a liner portion is cast, and then a cylinder block portion is cast.

20. A method according to claim 18, further including providing said mold with a liner portion forming wall so that a space between said liner portion forming wall and said core defines said first cavity, and wherein said liner material is supplied in a molten state into said first cavity.

21. A method according to claim 20, further including providing said liner portion forming wall of said mold made from copper, said forming wall having a cooling passage formed therein, and wherein when said liner material is supplied into said first cavity, cooling water is caused to flow through said cooling passage.

* * * * *